United States Patent [19]

Ellis

[11] 4,398,713

[45] Aug. 16, 1983

[54] EXERCISING DEVICE

[76] Inventor: Charles R. Ellis, 309 William St., Salisbury, Md. 21801

[21] Appl. No.: 289,416

[22] Filed: Aug. 3, 1981

[51] Int. Cl.[3] ..... A63B 23/02

[52] U.S. Cl. ..... 272/145

[58] Field of Search ..... 272/145, 146, 134; 128/25 R

[56] References Cited

U.S. PATENT DOCUMENTS

| | | | |
|---|---|---|---|
| 1,693,810 | 12/1928 | Daniels | 272/144 |
| 2,054,402 | 9/1936 | Williams | 272/144 |
| 2,673,736 | 3/1954 | Fiumedoro | 272/144 |
| 3,036,830 | 5/1962 | Hotas | 272/144 |
| 3,119,613 | 1/1964 | Zbyszko | 272/145 |
| 3,567,218 | 3/1971 | Johnson | 272/144 |
| 3,598,405 | 8/1971 | Burns | 272/145 |
| 3,682,475 | 8/1972 | Walker | 272/145 |
| 4,319,747 | 3/1982 | Rogers | 272/144 |

*Primary Examiner*—Richard J. Johnson

*Attorney, Agent, or Firm*—Connolly and Hutz

[57] ABSTRACT

A device for selectively permitting the user to do a plurality of different exercises from different body positions includes foot support means which are vertically and horizontally adjustably spaced from rotatable body support means.

16 Claims, 10 Drawing Figures

10
12
16
20
22
23
24
25
26
27
28
30
32
34
36
38
40
42
44
45
46
48
50
52
54
56
58
60
62
64
66
68
78
80
82
84

EXERCISING DEVICE

BACKGROUND OF INVENTION

Various exercising devices exist for permitting a user to do different types of exercises in different body positions to strengthen corresponding muscles. Such devices, however, are generally limited in the number of different exercises which could be effectively done thereon. It would be desirable to provide an exercising device which is versatile enough to permit the selective performance of a number of different exercises and with some therapeutic purpose rather than just creating body-strength and body-bulk. Since most devices strengthen muscle regions such as the arms, legs, chest, stomach, etc., regions, which for the most part with normal everyday usage are not readily susceptible to injury. Yet, one muscle group which is frequently injured with normal use, is the lower back or lumbar region. However, to strengthen this region one must do a variety of exercises circumferencing the lower trunk. These exercises which include sit-ups, back extensions and lateral extensions should be done as a group exercise to acquire the best results. The first circumference exercise, sit-ups, are frequently used to strengthen the abdominal muscles. While performing sit-ups, the user simply lies on his back and bends forward. The second exercise is the back extension where the user lays on his stomach and flexes the trunk downward and extends the trunk upward. This exercise specifically isolates the spinae erector muscles. The third, most unique, and most neglected exercise to prevent severe lower back strain is lateral extension which exercises congruently and simultaneously the abdominal oblique and quadratus lumborum muscles. The quadratus lumborum muscles are responsible for lateral movements of the trunk and are probably the most susceptible muscles to lower back injury or lower back strain. The abdominal oblique muscles compress the abdominal wall preventing protrusion and lordorsis of the abdomen.

It would be desirable to have an apparatus enabling one to do the lateral extension exercise allowing one to isolate the abdominal oblique and quadratus lumborum muscles which play in intricate role in the extension of the trunk from the flex position (i.e., straightening up after touching one's toes). This extension movement, however, actually employs a circumference of the lower trunk muscles, for example: the abdominal rectus formed anteriorally to the stomach and intestinal region; the spinae erector running vertically along the vertebral column; the abdominal oblique found laterally or rather on both sides of the individual, attached to the top of the pelvis (iliac), and to the lower rib cage; and the quadratus lumborum found in the immediate lower back on either side of the spinal column attaching to the last rib, lumborum vertebrae and pelvic crest, yet positioned more laterally than the spinae erector.

There are three primary reasons why one encounters lower back muscle strain. The first reason is the individual's neglect and ignorance of the abdominal oblique muscles allowing atrophy of this muscle group therefore losing their ability to contract and compress the abdominal wall. The second reason, which coincides with the first, is the increased elasticity of the abdominal rectus, due to a number of years of poor posture by the individual expecially while sitting. What occurs is that the individual slumps, relaxing the lower back and abdominal rectus muscles causing protrusion of the abdominal wall and increasing elasticity of the rectus muscles. As the abdominal rectus muscles become more elastic, they lose their force of contraction and yield a greater load upon the remaining three muscle groups, (spinae erector, abdominal oblique, and quadratus lumborum), during extension of the trunk. The third reason why one encounters lower back problems is simply that the individual is taught not to use this region in exercise, especially in strength development type work. Consequently, this area becomes weak from lack of a strong stimulus and lack of a high chemical metabolic activity within these muscle fibers. Furthermore, when the individual does use this region in some flexion and extension movement, he frequently uses poor body mechanics. For example, one may bend over to pick something up which is not directly in front of him (picking up a grocery bag from the seat of a car) and therefore may turn slightly (lateral movement) to accommodate this position. One would then apply the load to one quadratus lumbordum muscle and forward toward the oblique muscles. These areas not properly conditioned, cannot sustain the load, and therefore may encounter what is thought to be "contraction" of the muscle fibers, a state which the muscle fibers become fully contracted and will not relax; sometimes causing inflammation and prostaglandin synthesis, mediating pain.

Therefore, by acquiring a device with the versatility to accommodate all of these exercises, while at the same time accommodating individuals of different physical sizes, one may help prevent lower back strain by isolating, stimulating and conditioning the certain muscle groups which yield the the forces of contraction necessary to sustain a given load during extension of the trunk.

SUMMARY OF INVENTION

An object of this invention is to provide a single device capable of permitting a user to selectively do the above-indicated exercises.

A further object of this invention is to provide such a device which may be easily manufactured at low cost while yet containing sufficient components to accommodate the user's feet and body in the different positions required for each exercise.

In accordance with one aspect of this invention, a device is provided for exercising the abdominal oblique and quadratus lumbordum muscles which includes foot support means spaced from the body support means. The body support means includes a generally horizontal support member with upstanding projections extending away therefrom for minimizing any tendency of the body of the user to twist or roll while still providing support during the exercise.

In accordance with a further aspect of this invention, a device is provided for selectively permitting the user to do a plurality of different exercises from different body positions which includes a horizontal runner with foot support means mounted thereto as well as body support means mounted to the horizontal runner spaced from the foot support means. The foot support means includes a plurality of foot support members for selectively supporting the user's feet during the different exercises, and the foot support means is both vertically and horizontally adjustable for the desirable resistance and load and to comply with the physical size of the individual and his limbs.

In accordance with a further aspect of this invention, an exercising device is provided which is specifically designed for selectively permitting the user to do sit-ups and back extension exercises and also lateral extension which exercises the abdominal oblique and quadrutus lumbordum muscles. The device includes a horizontal runner with foot support means and body support means mounted thereto and spaced from each other. The foot support means includes sets of support members for selectively supporting the user's feet during the various exercise positions while the body support means likewise includes a plurality of different surfaces for correspondingly supporting the body during the different exercise positions.

THE DRAWINGS

DETAILED DESCRIPTION

Figures 1, 2:
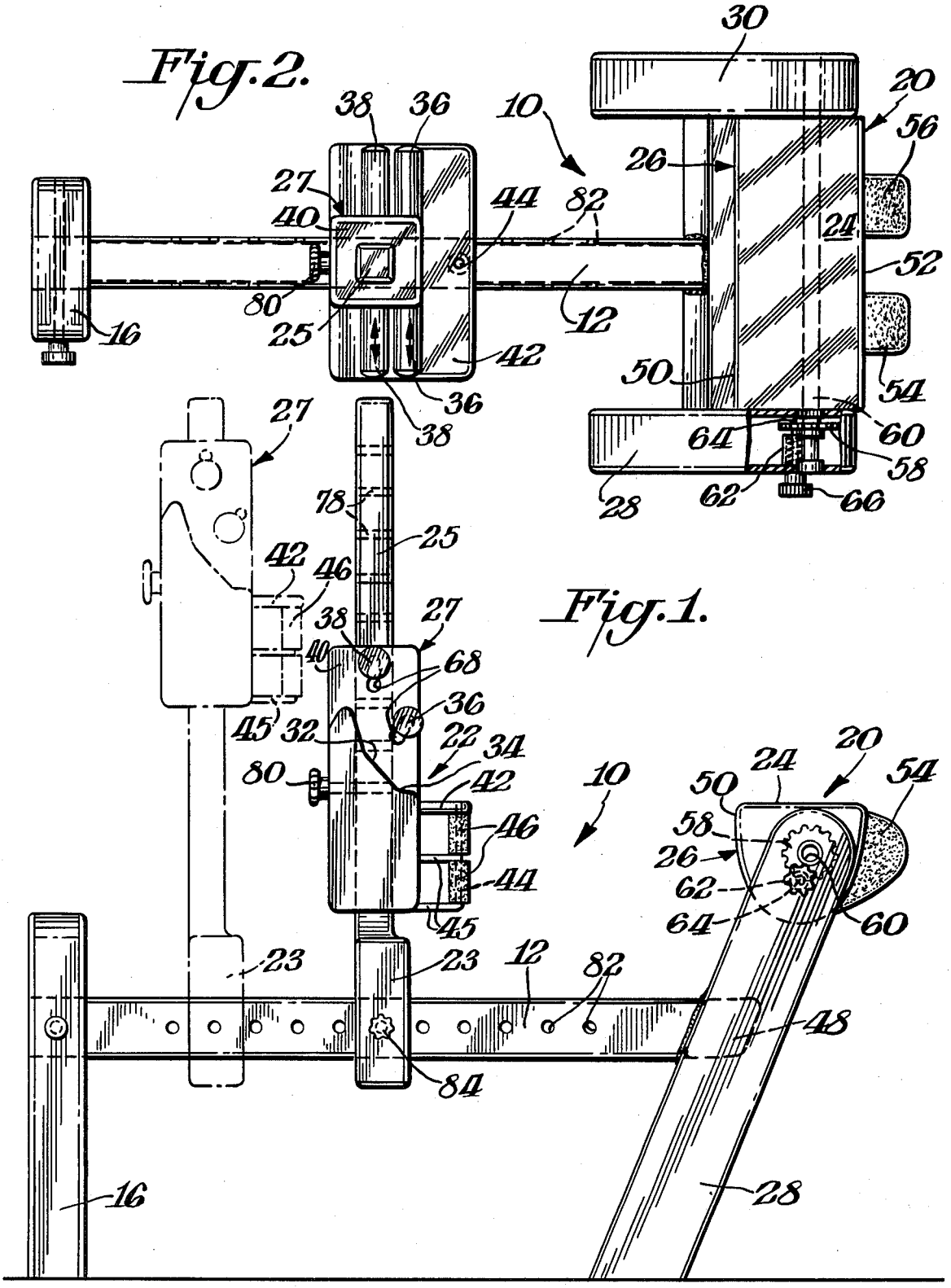
FIG. 1 is a side elevation view of an exercising device in accordance with this invention.
FIG. 2 is a top plan view of the device shown in FIG. 1.
Figure 5:
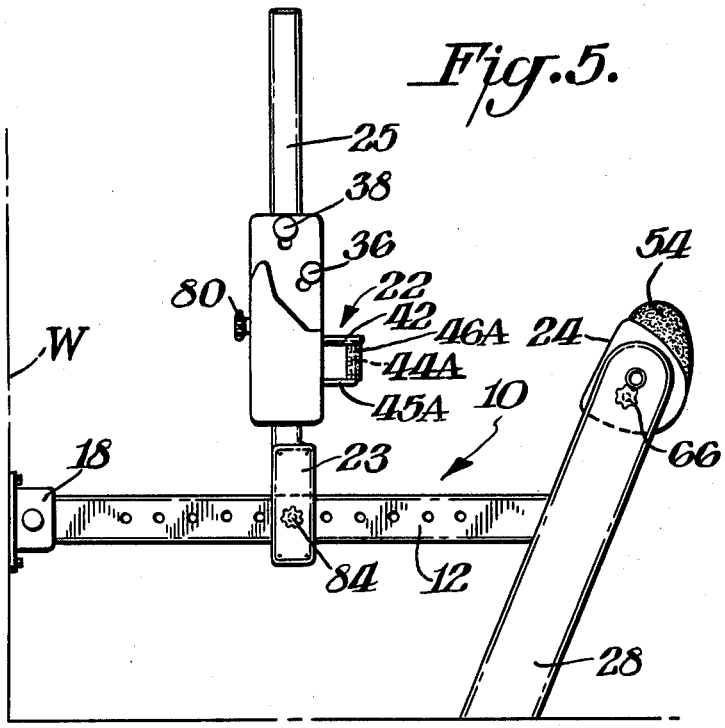
FIG. 5 is a view similar to FIG. 1 of an alternative exercising device.
Figure 3:
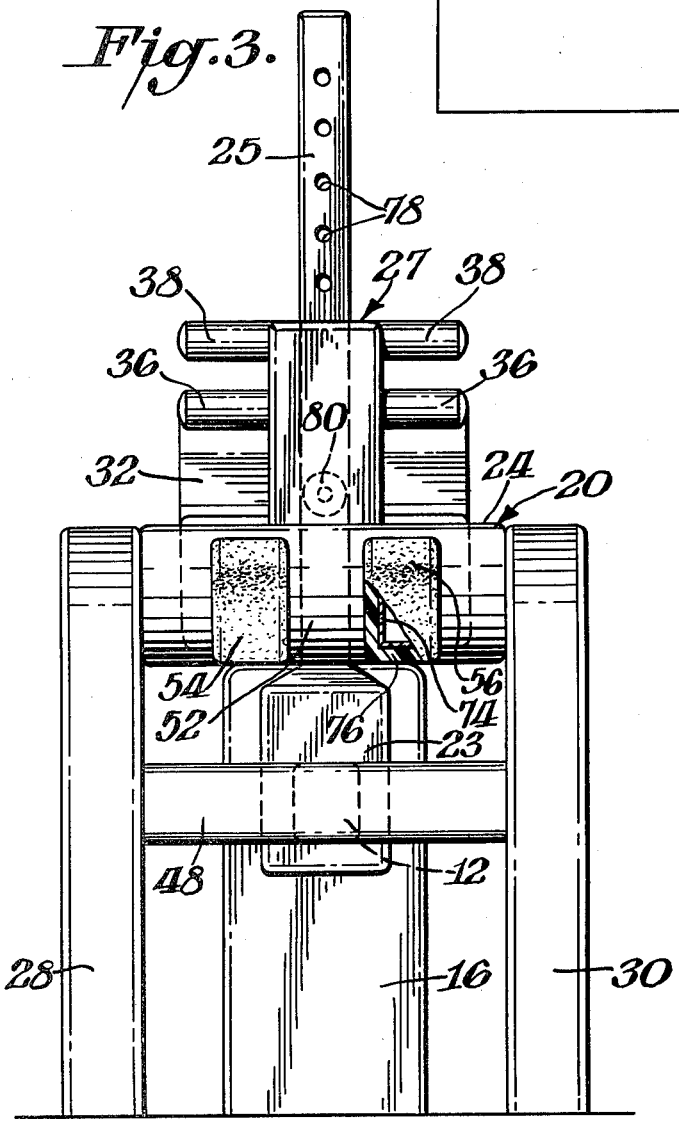
FIG. 3 is a front elevation view partly in section of the device shown in FIGS. 1–2.

FIGS. 1–3 show an exercising device 10 in accordance with this invention. As indicated therein, exercising device 10 includes a horizontal runner 12 which is mounted at one end to brace 14 and at the other end to brace 16. It is to be understood, however, that the specific manner of mounting or supporting runner 12 is not critical. Thus, FIG. 5 shows one end of runner 12 secured to a wall W by means of a bracket 18. Obviously any other type of support for runner 12 may be used as long as it meets the criteria of maintaining runner 12 both stationary and generally horizontal.

In accordance with this invention body support means 20 is mounted to brace 14 to thereby be secured to one end of runner 12. Additionally foot support means 22 is secured to horizontal runner 12 for vertical and horizontal adjustment with respect thereto as later described.

Figure 7A:
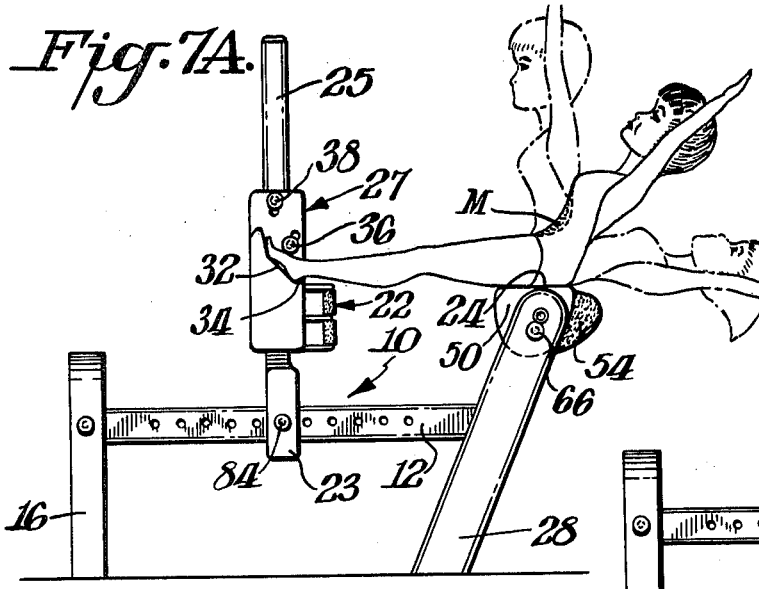
FIGS. 7–9 are side views in elevation of the device shown in FIGS. 1–3 selectively used for different exercises thereof.
Figure 7B:
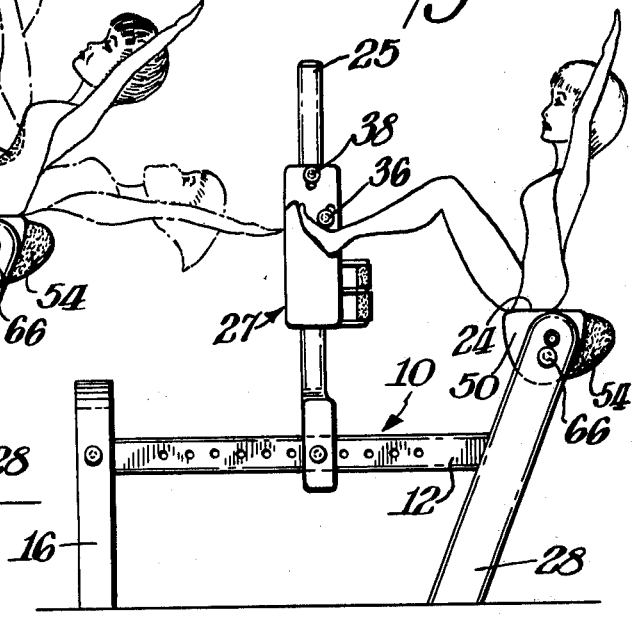
Figure 8:
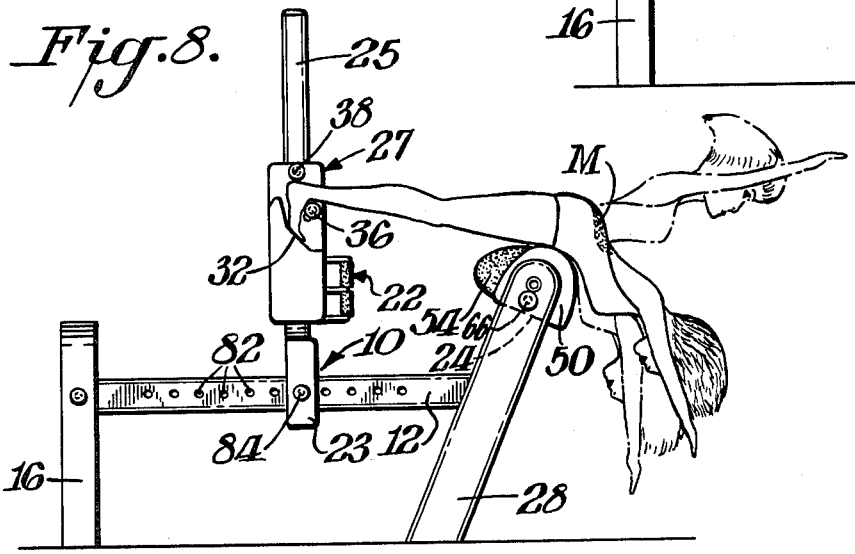
Figure 9:
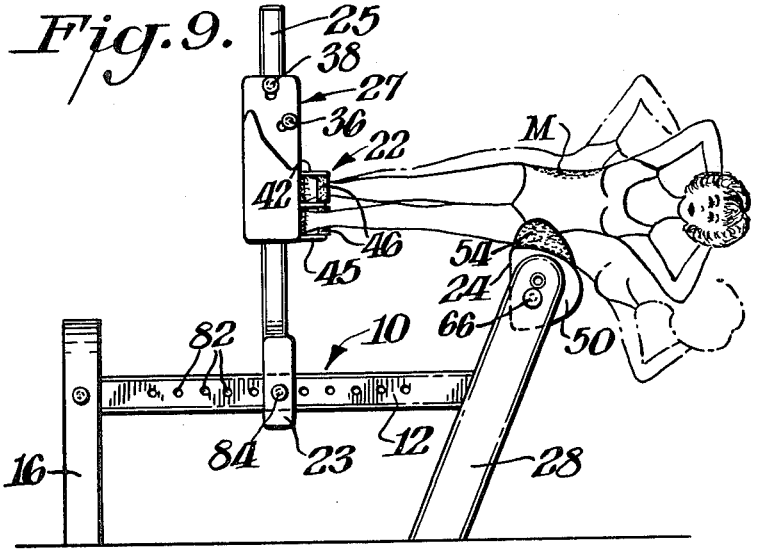

Device 10 is particularly designed to support a user while selectively doing a number of different exercises. Device 10 accomplishes this in such a manner as to accommodate different size users and also to vary the type of resistance or intensity of the particular exercise. In particular, device 10 is intended to permit a user to do sit-up exercises and back extension exercises as well as exercising the abdominal oblique and quadrutus lumbordum muscles. FIGS. 7–9, for example, show use of device 10 in these respective exercises.

Foot support means 22 includes a carriage 23 which straddles or is telescoped over horizontal runner 12 and supported thereby in such a manner as later described as to be able to move along runner 12. A vertical post 25 extends upwardly and integrally from carriage 23. Slidably vertically mounted on post 25 is an assembly 27 which includes a plurality of sets of foot support elements. These foot support elements include a pair of rods 36, 36 and 38, 38 extending on each side of block 40. Block 40 includes an inclined support surface 32 which terminates in a heel support member 34 on each side of its central portion. In this respect the central portion of block 40 may be made integral with the side portions or may be made of separate elements secured thereto. Attached to the front face of block 40 is a horizontal plate 42 from which is suspended an L-shaped bracket 44 with the vertical member of bracket 44 having suitable padding 46 therearound.

Body support means 20 includes a generally horizontal rotatable support member 26 which spans the standards 28, 30 used in forming brace 14. As best shown in FIG. 3, a further horizontal member 48 also spans standards 28, 30 with horizontal runner 12 being secured to horizontal member 48.

Horizontal support member 26 includes a plurality of different surfaces which may be disposed uppermost for supporting the body during different exercises. These surfaces include flat surface 24 for the sit-up exercise, rounded surface 50 for the back extension exercise and diametrically opposite rounded portion 52 for exercising the abdominal oblique and quadrutus lumbordum muscles. In connection therewith, a saddle formed by projections 54, 56 are also utilized during this latter exercise.

For doing a sit-up exercise the user sits on the flat surface 24 of rotatable body support member 26 which spans the two standards 28, 30 of brace 14. In the sit-up exercise the feet are supported as shown in FIGS. 7A and 7B by being located on inclined support surface 32 with the heel against heel support bar 34 and the ankle beneath rod 36. In use each leg would be on a different side of the central portion of block 40.

Advantageously foot support means 22 is horizontally adjustable along horizontal runner 12 as previously described. Thus it is possible to space foot support means 22 from body support means 20 not only to accommodate the particular body dimensions but also to vary the degree of flexion and dictate the manner in which the exercise would be done. For example, foot support means 22 may be located so that the user's legs would be bent during the sit-up exercise as shown in FIG. 7B. This would isolate the abdominal muscles and take strain off the lower back. If desired, however, foot support means 22 may be moved away from body support means 20 as shown in phantom in FIG. 1 so that the user's legs would be straight which would isolate the upper abdominal muscles above the navel as shown in FIG. 7A. Further the degree of flexion would be varied to increase or decrease the resistance by the vertical positioning of foot support means 22. Thus when block 40 is raised, as shown in phantom in FIG. 1, there would be an increase in resistance as compared to the lower position as shown in solid.

When the vertical position of foot support means 22 is altered, it would also be desirable to adjust the angularity of flat support surface 24 for proper alignment with foot support means 22. For example, when foot support means 22 is in its lowermost position, flat surface 24 might be horizontal. If foot support means 22 is elevated, however, it would be more desirable to incline flat surface 24 upwardly in general alignment with the position the legs would take spanning the distance between body support 20 and foot support 22. In accordance with one aspect of this invention, indexing means are provided for locking flat surface 24 in any preselected number of positions such as 12 or less different positions. Any suitable indexing means may be used for this purpose. FIGS. 1–2, for example, show a disc 58 secured to shaft 60 on which body support member 26 is mounted. Disc 58 contains a number of teeth or notches located for selective alignment with housing 62 in which is mounted a spring-loaded pin 64 having a knob 66. Knob 66 would be retracted to disengage pin 64 from disc 58 thereby permitting member 26 to be rotated and then locked in position in accordance with the appropriate notch or tooth engaged by pin 62 when knob 66 is released. Obviously any other suitable adjusting means may be used such as a ratchet-pawl arrangement.

Figure 6:
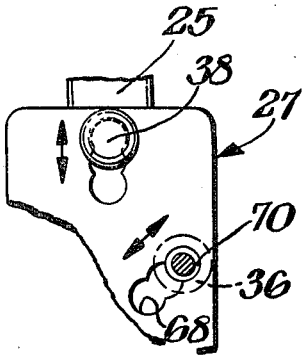
FIG. 6 is a side view in elevation of a portion of the foot support means shown in FIGS. 1–5.
Figure 4:
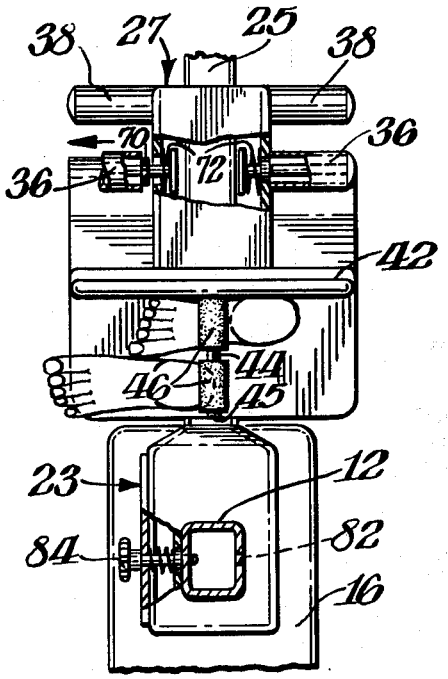
FIG. 4 is a front view partially in section of the foot support means incorporated in the device of FIGS. 1–3.

Device 10 may also be used for the spinae rectus or back exercise which would provide for back extension. In this exercise the user would lay on his stomach and bend down 90° from the flat position and then bend back up with the exercise being repeated. Device 10 is utilized by rotating body support member 26 so that the curved portion 50 would support the pelvic region of the user as shown in FIG. 8. In this position saddle 54, 56 would also be rotated out of the way so as not to interfere with the exercise. When doing this exercise the user's feet would be located as shown in FIG. 8 with each foot between a pair of support rods 36, 38 in such a manner that the Achilles tendon pushes against upper rod 38. To accommodate different users, support rods 36, 38 are adjustably mounted to block 40. In this respect FIGS. 4 and 6 best illustrate such adjustable mounting. As indicated in FIG. 6, for example, a slot 68 is formed in block 40 and with the edges thereon correspondingly shaped to form a number such as three sets of arcuate surfaces with slot 68 being arranged perpendicular to inclined surface 32. Support rods 36 are mounted as best shown in FIG. 4 as including a boss 70 on spring-loaded shaft 72 with boss 70 being shaped to fit into a set of arcuate surfaces and held therein under the influence of the spring. The position of support rod 36 may be varied by pulling outwardly as indicated by the arrow in FIG. 4 to dislodge boss 70 from slot 68 so that the smaller dimensioned shaft 72 is then located in slot 68 whereby shaft 72 may move freely in slot 68. A similar arrangement would be utilized for moving support rod 38 in a vertical direction so as to accommodate different size feet.

A particularly noteworthy feature of device 10 is the ability to permit a user to exercise the abdominal oblique and quadrutus lumbordum muscles for preventing adorsis which is the protrusion of the abdominal wall. In this exercise the user lays on his side and raises his body upwardly and then lowers his body. A notable feature of the invention is the provision of means for preventing the user's body from twisting or turning during this exercise. Such means is provided by saddle or extensions 54, 56 spaced from each other along surface 52 of support member 26. Advantageously body support member 26 may be indexed to any suitable number of positions such as three positions in the manner previously described regarding the sit-up exercise so as to control the disposition of the saddle.

As best shown in FIGS. 2 and 3, each projection 54 and 56 of the saddle includes a rigid member such as a plate or channel member 74 mounted to and extending outwardly from support member 26. Advantageously rigid member 74 is covered with padding such as heavy foam material 76. Although the saddle is illustrated as having the material on all sides of the rigid plate, what is essential is that the foam material be on the opposed inner surfaces. In this respect the provision of foam material provides a controlled clearance or area between the projections 54, 56 to accommodate the pelvic region between the projections with the foam material providing proper yieldability for different sized users. Thus the user can exercise by pivoting up and down about the pelvic region with a range of ± 65–75 percent of flexion. Advantageously, brace 14 is inclined so as to minimize any interference with the user particularly during this up and down pivoting. The position for the saddle would be such that the saddle is only partially raised to provide support on both sides of the user by means of the padded projections, and thus it is not necessary that the projections be in a completely vertical orientation. If desired, the projections may be adjustably mounted on horizontal member 26 to provide an even greater control of the spacing between the projections whereby it would not be necessary to simply rely on the padded material providing the support for the user.

As indicated in FIGS. 4 and 9, during the exercise of the abdominal oblique and quadrutus lumbordum muscles, the feet are supported by being wrapped around padded post 44. This may be done in any suitable manner such as wrapping a foot on each side of the post. FIG. 4, for example, shows the upper foot around post 44 and the Achilles tendon of the lower foot against post 44. Plate 42 serves the dual function of not only providing a means of mounting post 44 but also limiting the upward positioning of the feet. Similarly the horizontal member 45 of post 44 would likewise serve the dual function of mounting the post while limiting the lowermost position of the feet.

FIG. 5 shows an alternative where post 44A is of a length whereby one foot would be wrapped about padding 46A above horizontal member 45A and the other foot would be wrapped around that foot.

Although FIG. 9 shows the user in one position for exercising the abdominal oblique and quadrutus lumbordum muscles, the same exercise may be performed by the user simply turning so that his opposite side is located in the saddle.

FIGS. 7–9 indicate by shading and the reference character M the muscles particularly being exercised in the respective uses of device 10.

As previously indicated, foot support means 22 is both vertically and horizontally adjustable. The means of such adjustment is not critical. For example, in the illustrated form, vertical post 25 includes a plurality of horizontal holes 78 while spring-loaded pin 80 is mounted in block 40 for selective engagement with one of holes 78 to thereby control the vertical position of block 40. Similarly horizontal runner 12 includes a plurality of holes 82 which are engaged by spring-loaded pin 34 in carriage 23 to control the horizontal positioning of the foot support means 22. Obviously other adjusting means such as a rack and pinion may also be utilized.

Various materials and dimensions may be used for constructing device 10. Surface 32, for example, may be inclined 25°–30°. If desired, surface 32 may be contoured to more closely accommodate the foot.

As can be appreciated, device 10 thereby provides the user with a single device capable of permitting a number of different exercises, each requiring distinctly different positions. A notable characteristic of device 10 is that the foot support and body support are spaced from each other without any support surface therebetween. Additionally these support surfaces are elevated so as to minimize any interference to the user in properly accomplishing the various exercises.

What Is claimed is:

1. A device for selectively permitting the user to do sit-up and back extension and lateral extension exercises comprising a horizontal runner, a foot support assembly mounted to said horizontal runner, said foot support assembly comprising a first feet confining means for holding the user's feet generally stationary while the user's feet are disposed upwardly in the sit-up condition, a second feet confining means for holding the user's feet generally stationary while the user's feet are disposed downwardly in the back extension condition, a third feet confining means for holding the user's feet generally stationary while the user's feet are disposed in a sideways direction in the lateral extension condition, a pelvic support member mounted to said horizontal runner spaced from said foot support assembly, means for rotating said pelvic support member to one of a plurality of selected operative positions, said pelvic support member having a generally flat surface for supporting the user's pelvis in the sit-up condition to comprise one of said operative positions, said support member having a second surface for supporting the user's pelvis in the back extension condition to comprise another of said operative positions, said support member having a third surface for supporting the user's pelvis in the lateral extension condition to comprise a further of said operative positions, at least one of said second and said third surfaces being rounded, a pair of spaced upstanding projections extending outwardly away from said third surface to form a saddle in which the user's pelvis may be positioned for minimizing any tendency of the body of the user to twist or roll while providing support therefor, said saddle including means for accommodating different sized users, and said foot support assembly and said pelvic support member comprising the sole means for supporting the user's body whereby the user's body is thereby otherwise unsupported to maximize the degree of flexion and resistance and range of motion during the various exercises.

2. The device of claim 1 including indexing means for selectively locking said rotatable support member in one of a plurality of different positions.

3. The device of claim 1 including a brace on which said horizontal runner is mounted, said pelvic support means being secured to said brace, and said brace being inclined upwardly away from said foot support assembly.

4. The device of claim 1 wherein said spaced projections are padded to comprise said means for accommodating different sized users.

5. The device of claim 1 wherein said third feet confining means includes a vertically disposed rod means against which the user's feet may contact, and a generally vertical support surface rearwardly of said vertical rod means.

6. The device of claim 5 wherein said third feet confining means further includes a generally horizontally positioned support surface located above said vertical rod means.

7. The device of claim 6 wherein said third feet confining means further includes a generally horizontally positioned support surface located below said vertical rod means, said foot support assembly being laterally and vertically adjustable to be selectively moved up and down and toward and away from said pelvic support member, and said third surface of said pelvic support member being rounded.

8. The device of claim 1 wherein said first feet confining means comprises a set of generally horizontal rods against which the user's feet may contact, and support surface means rearwardly of said set of rods.

9. The device of claim 8 wherein said second feet confining means comprises two sets of generally horizontal rods against which the user's feet may contact, foot support surface means being rearwardly of said rods, and said second surface of said pelvic support member being rounded.

10. The device of claim 9 wherein said first feet confining means comprises one of said sets of generally horizontal rods and also said rearwardly disposed foot support surface means.

11. The device of claim 10 wherein said spaced projections are padded to comprise said means for accommodating different sized users, said third feet confining means including a vertically disposed rod means against which the user's feet may contact, a generally vertical support surface rearwardly of said vertical rod means, a generally horizontal positioned support surface located above said vertical rod means, a generally horizontal position support surface located below said vertical rod means, said foot support assembly being laterally and vertically adjustable to be selectively moved up and down and toward and away from said pelvic support member, and said third surface of said pelvic support member being rounded.

12. The device of claim 9 wherein one of said sets of rods is vertically adjustable and the other of said sets of rod members being angularly adjustable.

13. A device for permitting the user to do a lateral extension exercise comprising a horizontal runner, a foot support assembly mounted to said horizontal runner, said foot support assembly comprising generally vertical rod means against which the user's feet may contact while the user's feet are disposed in a sideways direction, first foot support surface means rearwardly of said rod means, second foot support surface means disposed above said rod means, a pelvic support member mounted to said horizontal runner spaced from said foot support assembly, said pelvic support member being rounded in its upper pelvic contacting surface, a pair of upstanding projections extending outwardly away from said rounded pelvic support surface to comprise a saddle in which the user's pelvis may be positioned for minimizing any tendency of the body of the user to twist or roll while providing support therefor, said saddle including means for accommodating different sized users, and said foot support assembly and said pelvic support member comprising the sole means for supporting the user's body whereby the user's body is thereby otherwise unsupported to maximize the degree of flexion during the exercise.

14. The device of claim 13 wherein said projections are padded to comprise said means for accommodating different sized users.

15. The device of claim 14 wherein a generally horizontal support surface is located below said vertical rod means, and said foot support assembly being vertically and horizontally adjustable to be selectively moved up and down and toward and away from said pelvic support member.

16. The device of claim 14 wherein each projection includes a rigid member mounted to said support surface with the padding mounted thereon.

* * * * *